US009480322B2

(12) United States Patent
Mortis Simons

(10) Patent No.: US 9,480,322 B2
(45) Date of Patent: Nov. 1, 2016

(54) COSMETICS STORAGE ASSEMBLY

(71) Applicant: Monifa L. Mortis Simons, Westbury, NY (US)

(72) Inventor: Monifa L. Mortis Simons, Westbury, NY (US)

(73) Assignee: Moifa L. Mortis Simons, Westbury, NY (US)

( * ) Notice: Subject to any disclaimer, the term of this patent is extended or adjusted under 35 U.S.C. 154(b) by 0 days.

(21) Appl. No.: 14/491,357

(22) Filed: Sep. 19, 2014

(65) Prior Publication Data

US 2015/0075556 A1 Mar. 19, 2015

Related U.S. Application Data

(60) Provisional application No. 61/879,926, filed on Sep. 19, 2013.

(51) Int. Cl.

| | |
|---|---|
| ***A45D 33/24*** | (2006.01) |
| ***A45D 33/26*** | (2006.01) |
| ***A45D 40/24*** | (2006.01) |
| *A45D 33/00* | (2006.01) |
| *A45C 5/00* | (2006.01) |
| *A45C 13/02* | (2006.01) |

(52) U.S. Cl.

CPC ..... *A45D 33/24* (2013.01); *A45D 33/008* (2013.01); *A45D 40/24* (2013.01); *A45C 5/005* (2013.01); *A45C 13/02* (2013.01); *A45D 33/006* (2013.01)

(58) Field of Classification Search

CPC ..... A45C 11/008; A45C 13/02; A45C 3/00; A45C 5/005; A45C 15/04; A45D 40/22; A45D 40/24; A45D 33/006; A45D 33/008; A45D 40/221; A45D 33/22; A45D 33/28

See application file for complete search history.

(56) References Cited

U.S. PATENT DOCUMENTS

| | | | | | |
|---|---|---|---|---|---|
| 1,601,892 | A | * | 10/1926 | Thralls | 132/296 |
| 1,628,793 | A | * | 5/1927 | MacDonald | A45D 33/006 132/306 |
| 1,883,852 | A | | 10/1932 | Medoff | |
| 1,931,004 | A | * | 10/1933 | Krueger | 132/298 |
| 2,149,183 | A | | 2/1939 | Reilly | |
| 2,573,309 | A | | 10/1951 | Chipkevich | |
| 2,574,345 | A | * | 11/1951 | Montgomery | B65D 75/38 206/233 |
| 2,730,152 | A | * | 1/1956 | Stakofsky | A45C 3/06 150/116 |

(Continued)

FOREIGN PATENT DOCUMENTS

| | | | |
|---|---|---|---|
| DE | 6923784 | U | 1/1970 |
| FR | 2823719 | A1 * | 10/2002 |

OTHER PUBLICATIONS

Patent Cooperation Treaty; PCT International Search Report, Issued in connection with PCT/US14/56583; Dec. 23, 2014; 2 pages; U.S.

(Continued)

*Primary Examiner* — Robyn Doan
(74) *Attorney, Agent, or Firm* — Greenberg Traurig LLP

(57) ABSTRACT

A cosmetics storage assembly is provided. The cosmetics storage assembly can include a compact box and a cosmetics tray disposed in the compact box. The cosmetics tray can have a plurality of wells formed therein adapted for holding cosmetics materials. The compact box can include a floor panel, a cover panel, and a plurality of side panels. The floor panel, cover panel and side panels can fold along seams therebetween to form a chamber and the cosmetics tray can be disposed within the chamber.

1 Claim, 10 Drawing Sheets

(56) References Cited

U.S. PATENT DOCUMENTS

| | | | | | |
|---|---|---|---|---|---|
| 2,734,517 | A * | 2/1956 | Ferraro | 132/295 | |
| 2,823,681 | A * | 2/1958 | Miller | 132/295 | |
| 2,851,041 | A * | 9/1958 | Grosso | 132/294 | |
| 3,469,765 | A | 9/1969 | Mueller | | |
| D261,826 | S | 11/1981 | Webb | | |
| 4,421,127 | A | 12/1983 | Geer | | |
| 4,589,430 | A | 5/1986 | Sussman | | |
| 4,726,387 | A | 2/1988 | Sarica | | |
| 4,826,014 | A | 5/1989 | Schefer | | |
| 5,092,354 | A | 3/1992 | Pacelli, Jr. | | |
| 5,398,706 | A * | 3/1995 | Epstein | A45D 33/006 | 132/273 |
| 5,437,294 | A * | 8/1995 | Ebbets, III | A45D 40/22 | 132/296 |
| 5,460,288 | A | 10/1995 | Balzeau | | |
| 5,520,202 | A * | 5/1996 | Arbree | A45C 11/008 | 132/148 |
| 5,520,203 | A | 5/1996 | Segerstrom | | |
| 5,544,750 | A | 8/1996 | Randall | | |
| 6,062,235 | A | 5/2000 | Renna | | |
| 6,126,009 | A | 10/2000 | Shiffler et al. | | |
| 6,138,686 | A | 10/2000 | Yuhara | | |
| 7,594,373 | B2 | 9/2009 | Abergel | | |
| 7,854,317 | B1 | 12/2010 | Hebert et al. | | |
| 7,861,856 | B2 | 1/2011 | Rowe | | |
| 7,975,706 | B2 | 7/2011 | Chen | | |
| 8,770,209 | B2 * | 7/2014 | Kim | A45D 33/26 | 132/294 |
| 2004/0003825 | A1 * | 1/2004 | Kelly | A45D 33/008 | 132/301 |
| 2005/0172981 | A1 | 8/2005 | Byun | | |
| 2005/0173285 | A1 | 8/2005 | Moncrief | | |
| 2006/0042992 | A1 | 3/2006 | Vulcano | | |
| 2006/0054517 | A1 | 3/2006 | Albert | | |
| 2006/0112966 | A1 | 6/2006 | Phue | | |
| 2006/0213789 | A1 * | 9/2006 | Ghini et al. | 206/268 | |
| 2006/0219256 | A1 | 10/2006 | Byun | | |
| 2006/0283753 | A1 | 12/2006 | Shinar | | |
| 2007/0045149 | A1 * | 3/2007 | Hession | 206/538 | |
| 2007/0261710 | A1 | 11/2007 | Son et al. | | |
| 2008/0023023 | A1 * | 1/2008 | Boye | A45C 11/008 | 132/294 |
| 2010/0059081 | A1 | 3/2010 | Yoshida et al. | | |
| 2010/0084460 | A1 * | 4/2010 | Lo Duca | 229/223 | |
| 2010/0193395 | A1 * | 8/2010 | Mowery | 206/528 | |
| 2010/0307530 | A1 | 12/2010 | Bennett | | |
| 2012/0279514 | A1 * | 11/2012 | Ricard et al. | 132/200 | |
| 2013/0015098 | A1 | 1/2013 | Chen | | |

OTHER PUBLICATIONS

Patent Cooperation Treaty; PCT Written Opinion of the International Searching Authority, Issued in connection with PCT/US14/56583; Dec. 23, 2014; 7 pages; U.S.

Muse, Isabella; Make Up for Ever La Boheme Baked Eye Shadow Palette Review & Swatches; Dec. 16, 2014; 14 pages; from http://www.musingsofamuse.com/2012/03/make-up-for-ever-la-boheme-baked-eye-shado . . .

European Patent Office; Patent Translation for DE6923784; 7 pages; Europe.

* cited by examiner

FIG. 2A
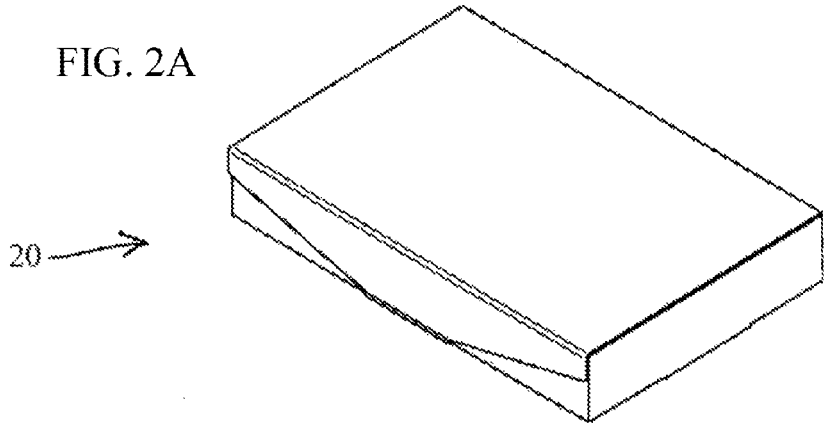
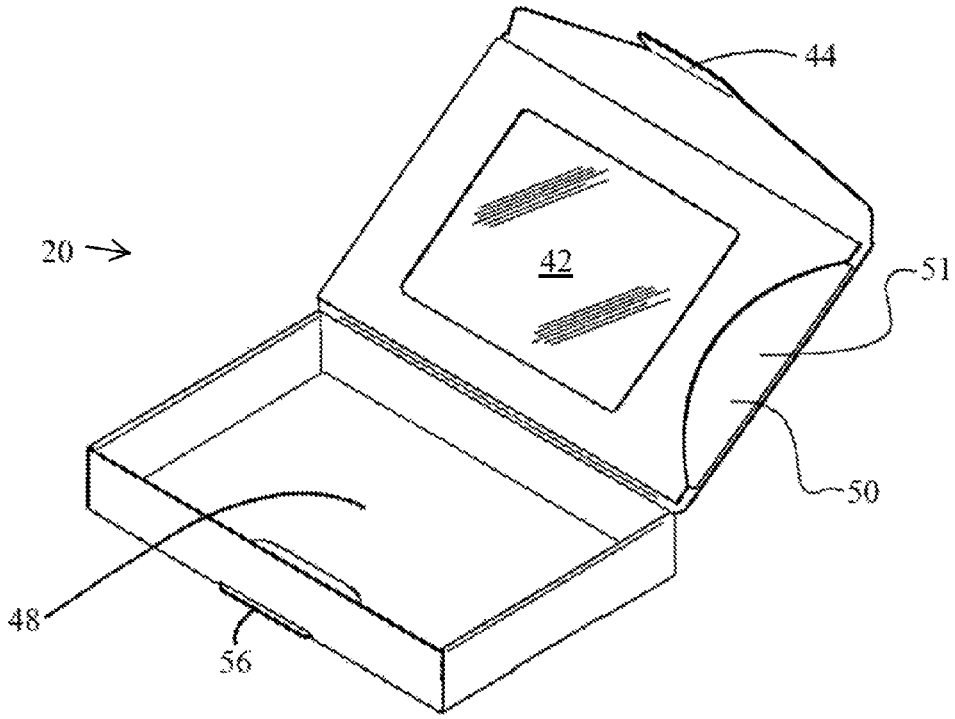
FIG.2B

COSMETICS STORAGE ASSEMBLY

RELATED APPLICATIONS

This application claims the benefit, and priority benefit, of U.S. Provisional Patent Application Ser. No. 61/879,926, filed Sep. 19, 2013, titled "Cosmetics Storage Assembly," the disclosure of which is incorporated herein in its entirety.

BACKGROUND

1. Field of Invention

The invention relates generally to storage of cosmetics, and in particular, to a cosmetics storage assembly.

2. Description of the Related Art

A person has paid to have makeup professionally applied by a makeup artist for a special event. As all makeup artists know, the ongoing challenge is how the person can maintain a fabulous face throughout the event using the same exact products originally used by the makeup artist. Unless the makeup artist gives the client samples from his or her own makeup, which is not likely, or the client pays to have the makeup artist follow them to the event for touch ups, which is equally unlikely, the client will have to substitute the products used by the makeup artist with less than ideal replacement versions. This is especially disappointing when it comes to lip color because clients want to keep the same look they paid for.

Alternatively, a person has applied makeup meticulously for a special event. The ongoing challenge is applying touch-ups throughout the night. The typical evening bag is small, so the person can barely fit in cell phone, keys, money, I.D., tickets, breath mints, and credit cards. How can the person also fit a lip stick, lip gloss, lip balm, powder, and a compact mirror—let alone applicators?

These scenarios are common and frequent occurrences in our society. We have become a celebrity driven culture that is placing a higher emphasis on glamorous social living. Makeup touch ups are essential to the social experience. Touch ups allow a user to enjoy the eating and drinking that comes with the occasion without compromising his or her appearance. Touch ups are also necessary to keep the user's face "camera ready" for photo ops and video. This is especially true for men or women with oily skin who are burdened with the challenge of keeping their skin fresh and "camera ready."

The popular option of users choosing to preserve their face by not eating, drinking, touching, kissing, smoking, hugging, moving, breathing, laughing, or sweating is extremely difficult and dreadful and should become a thing of the past. Trying to touch up one's face by toting a full sized powder, lip stick, lip gloss, lip balm, powder and a mirror compact is also less than ideal because the typical evening bag is too small to carry all the items necessary. Long-lasting products offered in the market like "16 hour" wear lipstick and "All Day Wear" powders, are uncomfortable, unreliable formulas that use very harsh ingredients. What a user needs is just enough of a sample-sized amount of product to last them through an event.

Thus, an innovative way of carrying and storing cosmetics items is desired.

SUMMARY

Various illustrative embodiments of a cosmetics storage assembly are provided herein. In an illustrative embodiment, the cosmetics storage assembly can include a compact box and a cosmetics tray disposed in the compact box. The cosmetics tray can have a plurality of wells formed therein adapted for holding cosmetics materials. The compact box can include a floor panel, a cover panel, and a plurality of side panels. The floor panel, cover panel and side panels can fold along seams therebetween to form a chamber, and the cosmetics tray can be disposed within the chamber. A base panel can be disposed adjacent to the floor panel. The base panel can share a seam with the floor panel and the panels can be folded together such that base panel sits atop the floor panel inside the chamber of the compact box. The cover panel can be movable relative to the floor panel between an open position and a closed position with respect to the compact box. A flap can be disposed adjacent to the cover panel. The flap can be foldable with respect to the cover panel to form a sleeve opening between the flap and the cover panel. A tissue packet can be disposed in the sleeve opening. The tissue packet can have a perforated opening for accessing tissue disposed therein. A mirror can be positioned within the sleeve that is viewable through an opening in the flap. Each of the wells of the cosmetics tray can have a cover flap that is coupled to the cosmetics tray and movable between an open and a closed position. The cover flap can have an extended tab with a gripping bump disposed thereon. The cosmetics tray can have a powder well with a floor having a plurality of raised ridges formed therein. A powder puff can be removably disposed in the powder well. The powder puff can have a handle such as a ribbon disposed thereon for grasping by the user. The cosmetics tray can have a cosmetics tool well that is formed therein. The cosmetics tool well can have at least one separating barrier disposed therein for separating the cosmetics tools. The cosmetics tool well can have a floor with a raised platform thereon. The raised platform can be tilted at an incline.

In another illustrative embodiment, the cosmetics storage assembly can include a panel material. The panel material can include a floor panel, a front panel, a cover panel and a base panel that are adaptable to be folded into a compact box having a cavity formed therein. The cosmetics storage assembly can also include a cosmetics tray that sits within the cavity of the compact box. The cosmetics tray can have a plurality of wells formed therein for holding cosmetic materials.

BRIEF DESCRIPTION OF THE DRAWINGS

FIGS. 2A and 2B are perspective views of a compact box in an open and closed configuration in illustrative embodiments.

While certain preferred illustrative embodiments will be described herein, it will be understood that this description is not intended to limit the subject matter to those embodiments. On the contrary, it is intended to cover all alternatives, modifications, and equivalents, as may be included within the spirit and scope of the subject matter as defined by the appended claims.

DETAILED DESCRIPTION

Referring now to FIGS. 1-9, various illustrative embodiments of a cosmetics storage assembly 10 are disclosed herein. In certain illustrative embodiments, assembly 10 can comprise a compact box 20. Compact box 20 can be utilized to store tissues, a mirror and/or a cosmetics tray and related materials, in certain illustrative embodiments.

Figure 1:
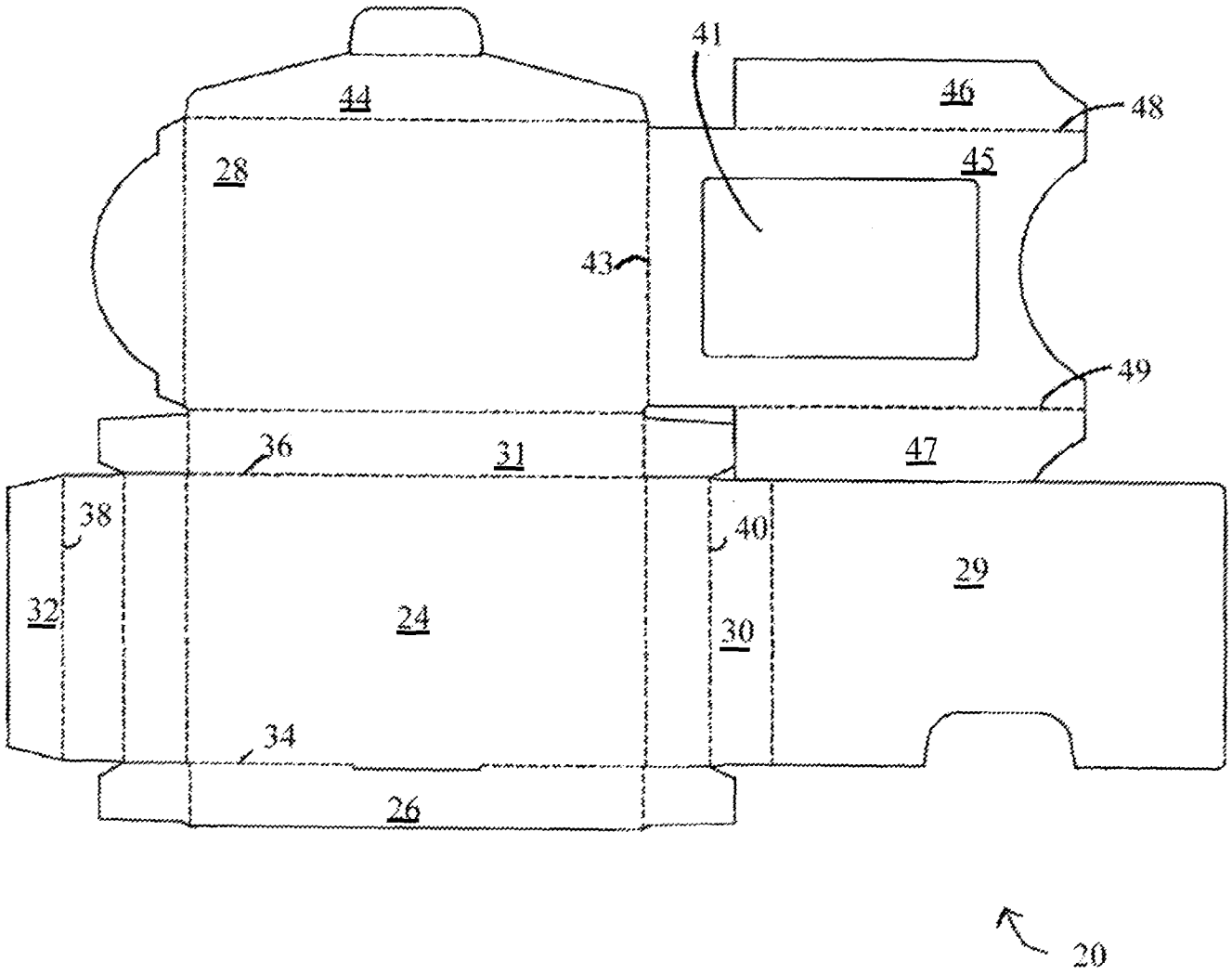
FIG. 1 is a top view of a flat panel for a compact box in an unfolded configuration in an illustrative embodiment.

As illustrated in, e.g., FIG. 1, compact box 20 can generally comprise a floor panel 24, a cover panel 28 and a base panel 29. Compact box 20 can also have a plurality of side panels including but not limited to a front panel 26, lateral side flaps 30 and 32 and a rear panel 31. Floor panel 24 can have lateral side flaps 30 and 32 affixed on either side thereof and extending in opposite directions. Floor panel 24 and front panel 26 can meet at foldable seam or panel 34. Floor panel 24 and cover panel 28 can meet at foldable seam or panel 36. Lateral side flaps 30 and 32 can meet floor panel 24 at foldable seams or panels 38 and 40, respectively. Panels 24, 26, 28, 29, 30 and 32 can be formed from paperboard material and can be folded from an unassembled flat panel material in an unfolded configuration into a folded configuration to form assembled compact box 20.

In certain illustrative embodiments, cover panel 28 can have a mirror 42 affixed thereto or otherwise secured in an embossed region formed therein. Alternatively, cover panel 28 can have a flap 45 that can be folded over at the seam or intersection 43 between flap 45 and cover panel 28 such that flap 45 can be glued or otherwise affixed to cover panel 28 and mirror 42 can be secured or stored therebetween. Cover panel 28 can also have an end flap 44 disposed thereon for securing the cover of compact box 20 closed when in the folded and assembled configuration.

Figure 5:
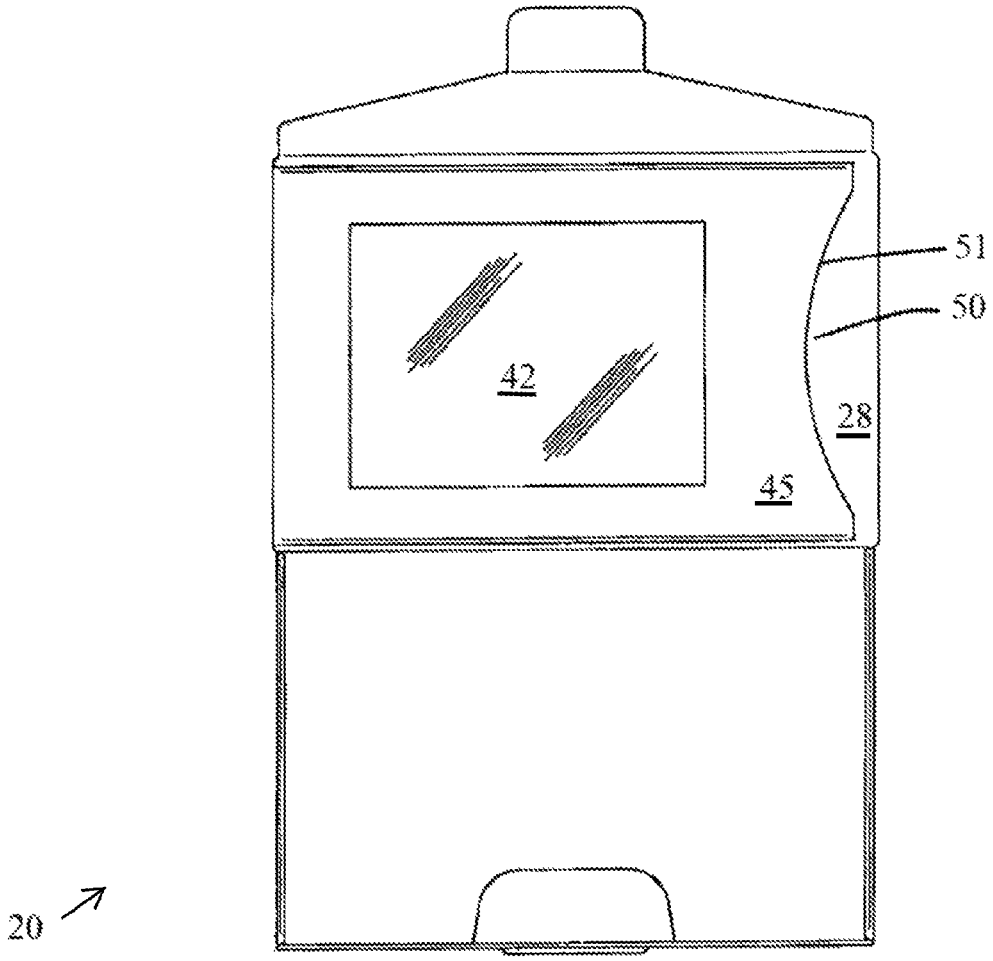
FIG. 5 is a top view of a compact box in an open configuration in an illustrative embodiment.
Figure 6:
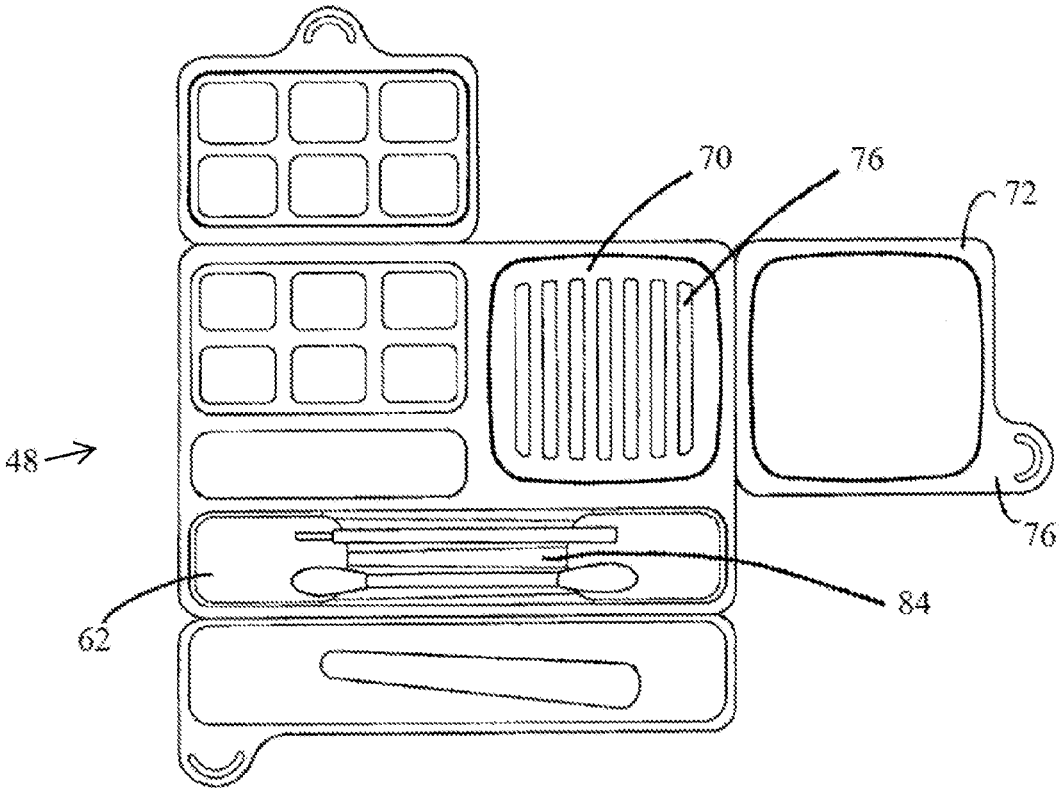
FIG. 6 is a top view of a cosmetics tray in an open configuration in an illustrative embodiment.
Figure 7:
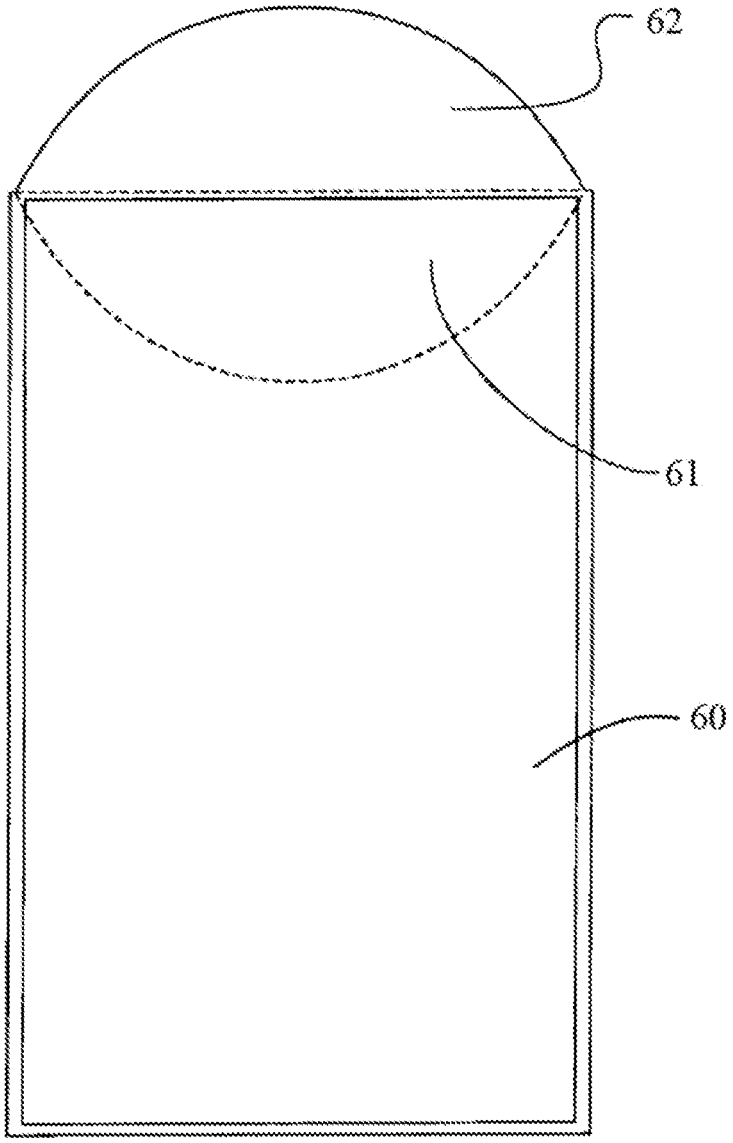
FIG. 7 is a top view of a tissue packet in an illustrative embodiment.
Figure 8:
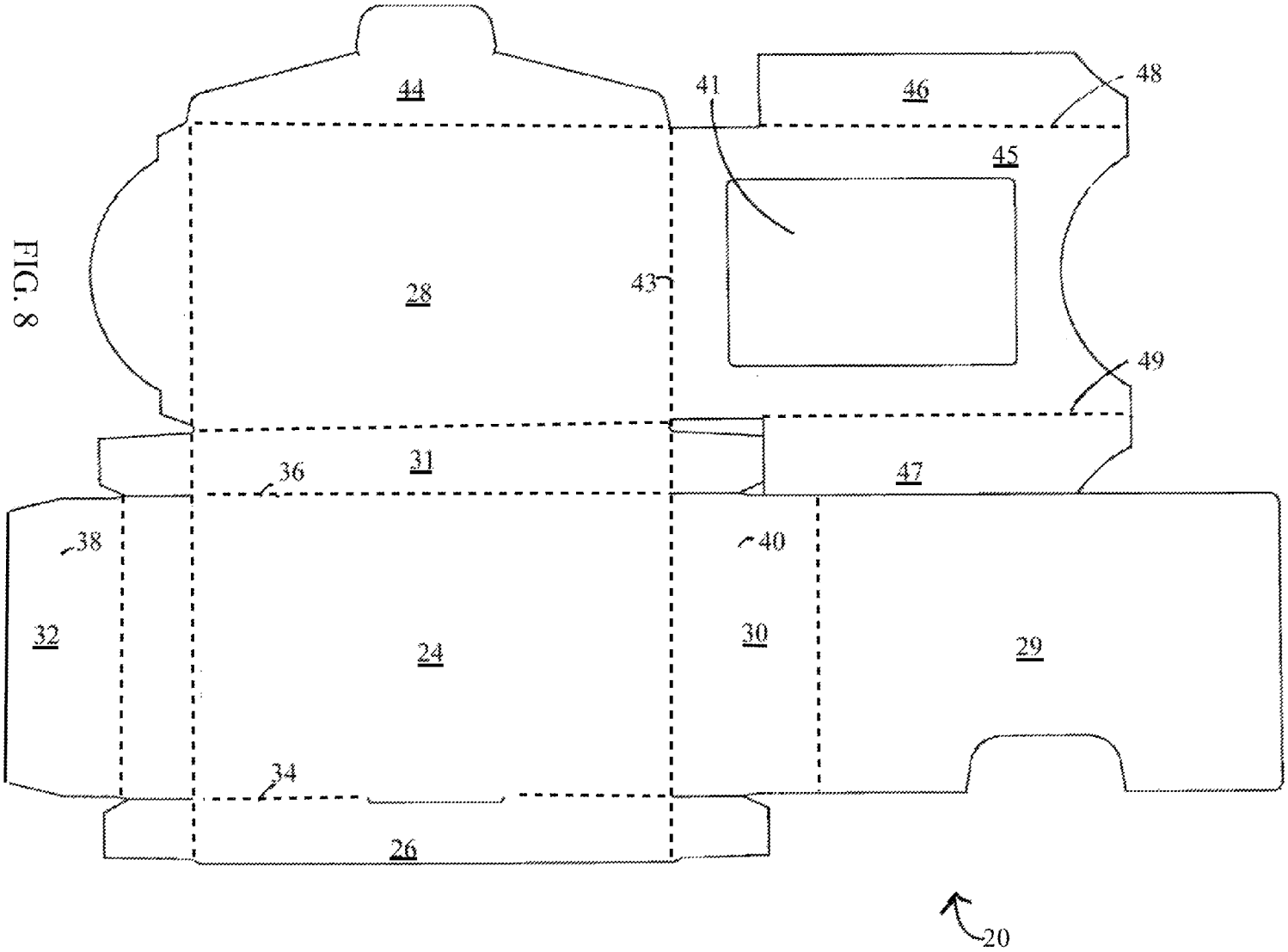
FIG. 8 is a top view of a compact box in an unfolded configuration in an illustrative embodiment.
Figure 9:
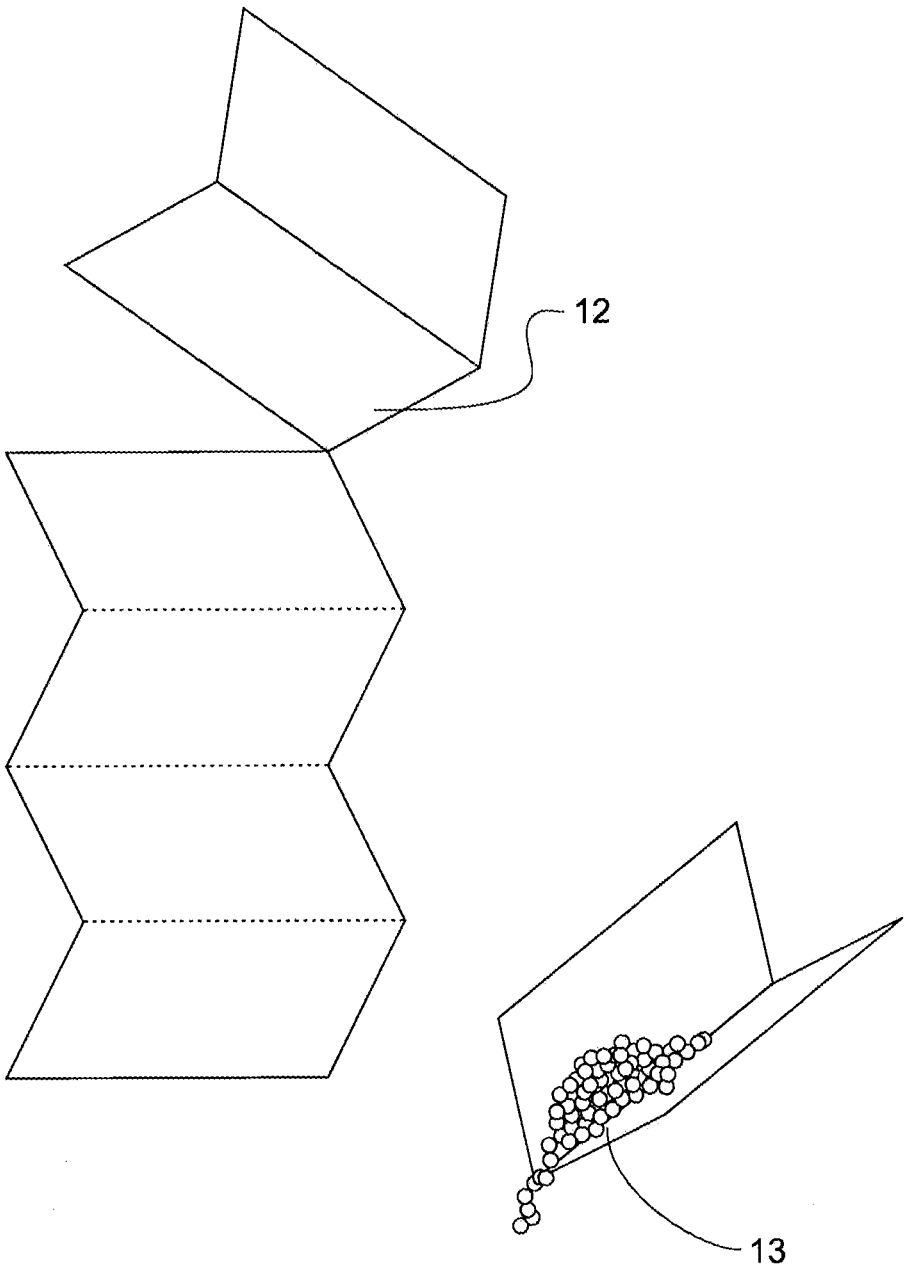
FIG. 9 is a perspective view of a funnel in an illustrative embodiment.

As illustrated in, e.g., FIGS. 5 and 7, a stack of tissues can be removably secured behind flap 45 after flap 45 is glued or affixed to cover panel 28. In an illustrative embodiment, lateral side flaps 46 and 47 on flap 45 can be folded over at seams 48 and 49 to create a sleeve or pocket 50 that can secure the tissues in place. The stack of tissues will sit in pocket 50 between cover panel 28 and flap 45.

In certain illustrative embodiments, pocket 50 can have an opening 51 formed therein to allow a user to remove one or more tissues from pocket 50. In certain illustrative embodiments, opening 51 can be "C" shaped, which exposed a large surface area of the tissues and allows the user to easily grasp the tissues and slidingly remove them from pocket 50. Further, in certain illustrative embodiments, the tissues can be stored in a tissue packet 60 (see FIG. 7) having a custom perforated opening 61 with flap 64 on its side that allows for tissues to be pulled out of packet 60 one at a time while packet 60 remains tucked within pocket 50.

In certain illustrative embodiments, mirror 42 can be affixed to flap 45 or otherwise secured on the underside section of flap 45, adjacent to opening 51 where tissue is dispensed. A window 41 can be formed in flap 45 through which mirror 42 can be viewed. This allows the user to see his/her reflection at the same time they are using the tissue dispenser or makeup tray in compact box 20.

As illustrated in, e.g., FIGS. 2A, 2B, 3A, 3B and 3C, compact box 20 can be formed from paperboard material and can be folded into a configuration that can secure a cosmetics tray 48 therein, in certain illustrative embodiments. Cosmetics tray 48 can be removable and disposable. Upon assembly, compact box 20 can have a hollow interior compartment which defines an opening in which cosmetics tray 48 can sit. In certain illustrative embodiments, base panel 29 can be folded so that it sits upon floor panel 24 within the hollow interior compartment of cosmetics tray 48 and reinforces cosmetics tray 48 to make it sturdier. Cosmetics tray 48 can sit upon base panel 29 within cosmetics tray 48, in certain illustrative embodiments. Alternatively, cosmetics tray 48 can sit upon floor panel 24 when base panel 29 is not included as part of compact box 20, in certain illustrative embodiments.

Figures 3A, 3B:
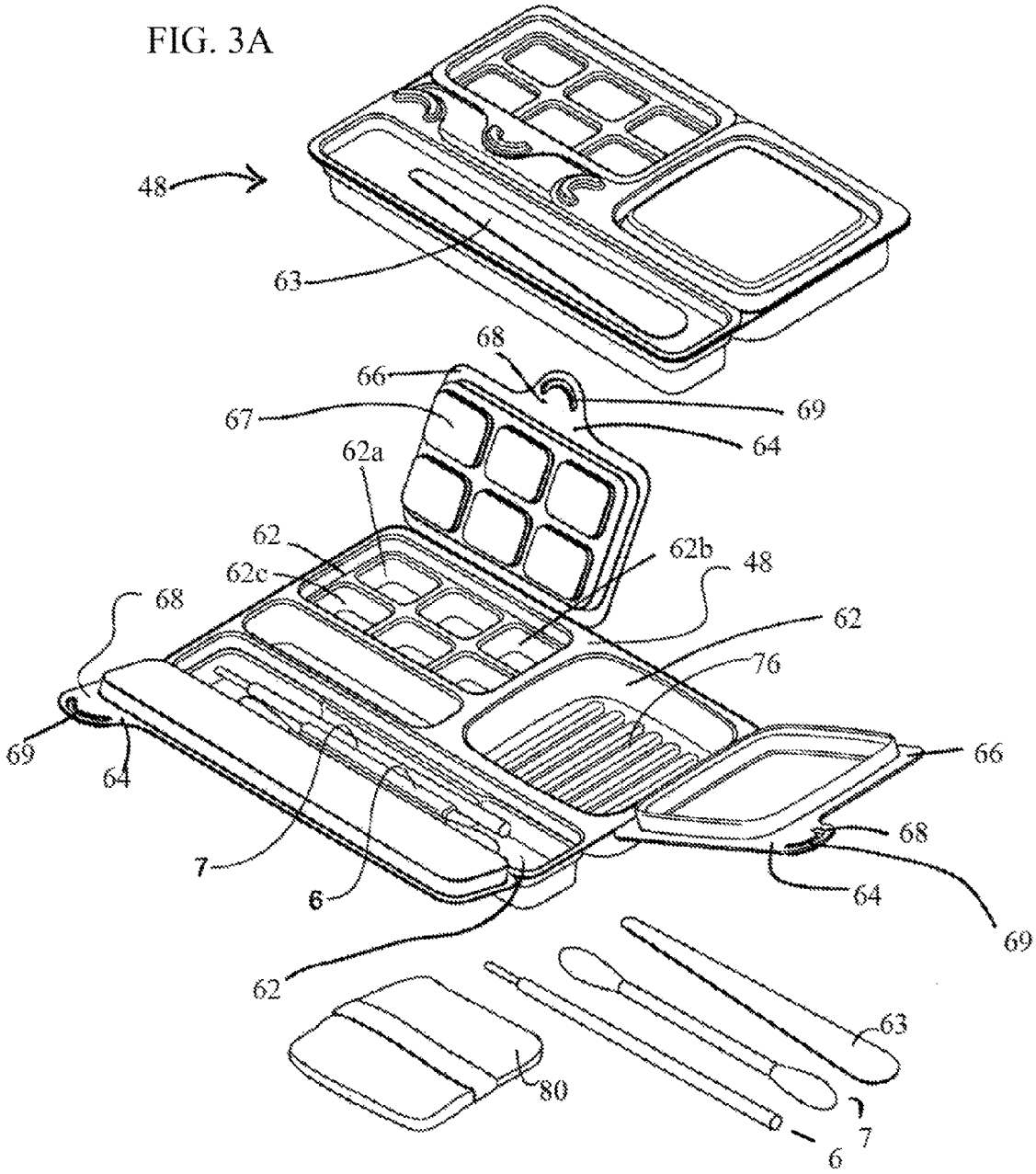
FIGS. 3A, 3B and 3C are various perspective views of a cosmetics tray in open or closed configurations and materials therefor in illustrative embodiments.
Figure 3C:
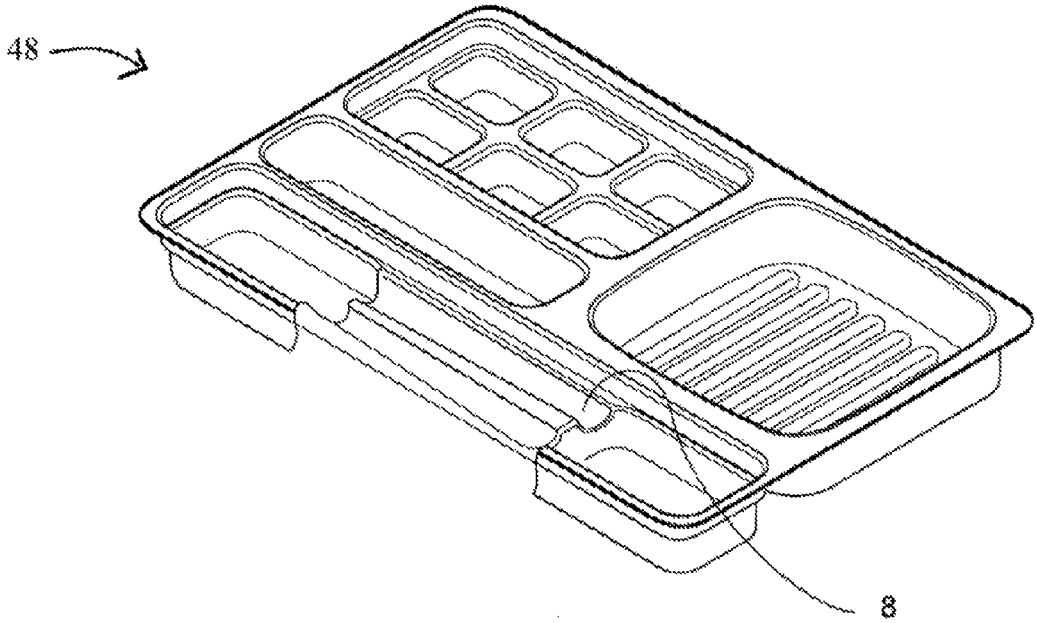
Figure 4:
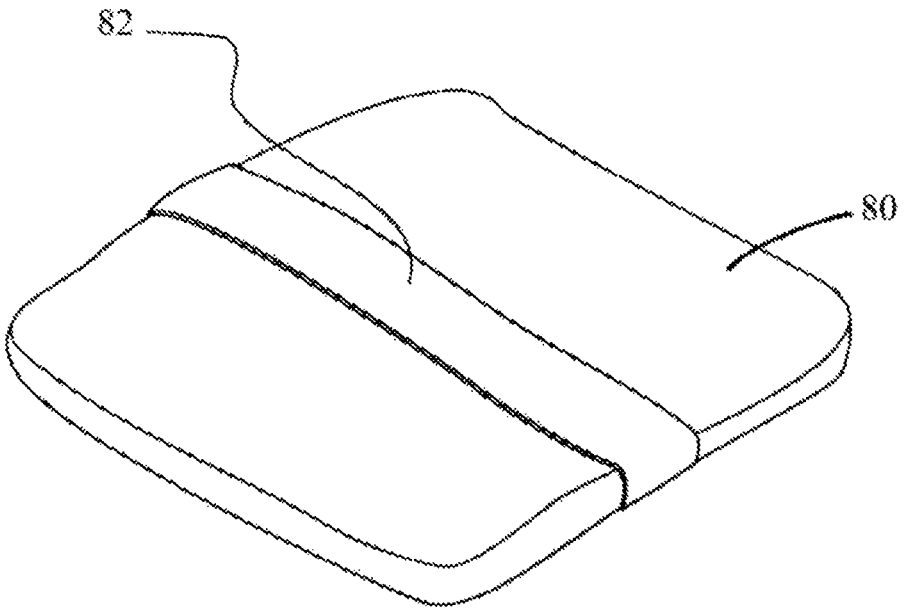
FIG. 4 is a perspective view of a powder puff and handle in an illustrative embodiment.

As illustrated in, e.g., FIG. 3B, cosmetics tray 48 can include a plurality of wells 62 formed therein for holding various cosmetics-related items, such as lip stick, lip gloss, lip balm, powder, powder puffs, cosmetic applicators, lip brushes, etc. . . . In certain illustrative embodiments, cosmetics tray 48 can have one or more cover flaps 64 affixed thereto to protect and seal each of the individual wells 62. In certain illustrative embodiments, each flap 64 can have a hinged, depressed lid 66 with an extended lip 68 with a gripping bump 69 formed thereon that the user can grab, pull up and/or press back down. Thus, a user can keep a particular individual lid 66 closed to prevent spillage from a corresponding well 62 that is not being utilized while other wells 62 are in use.

The number of wells and subwells in tray 48 can vary in various illustrative embodiments. In the embodiment shown, for example, in FIGS. 3A and 3B, tray 48 has three wells 62 formed therein, with one or more sub-wells 62*a*, 62*b*, 62*c*, etc. . . . formed within one of the three wells 62, particularly, well 62 containing make-up. Each well 62 has its own flap 64 which creates a depressed closure that seals in the contents of each individual well 62. In certain illustrative embodiments, flap 64 can have depressed sealing bumps 67 formed therein that are sized to fit within each individual subwell 62*a*, 62*b*, 62*c*, etc. . . . in one or more of the wells 62, to seal the individual subwells 62*a*, 62*b*, 62*c*, etc. . . . and prevent spillage.

In certain illustrative embodiments, tray 48 can include a well 62 with a divided space for housing makeup tools 6, 7 like a cosmetic applicator & lip brush, etc. . . . . The cosmetic applicator can be a dual-ended swab with a flat, rounded tip on one end and a coned, pointed tip on the other, in certain illustrative embodiments. The space in well 62 can be divided by a separating wall 84 (see FIG. 6). The tools 6, 7 can be used for the application and cleaning of cosmetics. Separating wall 84 keeps the tools 6, 7 from touching one another which prevents transference of product between the tools 6, 7. Further, as illustrated in, e.g., FIG. 3C, well 62 can have a raised platform 8 on its bottom floor to allow ease of access for the user. That is, raising the tools 6, 7 slightly requires less digging by the user to access the compact sized tools. In certain illustrative embodiments, the raised platform 8 can be set at an incline to further assist users in accessing the tools 6, 7 therein. In certain illustrative embodiments, a spatula 63 can be included for scraping and scooping the cosmetics from the original packaging and dispersing them into the tray (See FIG. 3A). A funnel 12 can also be provided (See FIG. 9). In certain illustrative embodiments, funnel 12 can be a paper panel that is a tear-off from the instruction manual accompanying compact box 10. Funnel 12 is provided to help consumers to transfer the product 13 neatly. Funnel 12 and spatula 63 are additional tools that are utilized in the transference of product 13 from one package to another, in certain illustrative embodiments.

In certain illustrative embodiments, tray 48 can include a loose powder tray 70. As shown in, e.g., FIG. 6, loose powder tray 70 can include a hinged cover flap 72. In certain illustrative embodiments, hinged cover flap 72 can be a sifter flap for sifting loose powder. The sifter flap can contain a plurality of small sifting holes that can control the dispersing of the powder. An extended lip 76 can be formed on cover flap 72 that the user can grab, pull up and/or press back down. Cover flap 72 can also have a depressed pocket formed therein for holding a powder applicator such as a powder puff 80 (see FIG. 4). Powder puff 80 can have a handle 82 formed thereon to wrap around the finger of the user. Handle 82 can be a ribbon, in certain illustrative embodiments. Due to the compact size of puff 80, handle 82 allows a user to grasp puff 80 without dropping it. Powder applicator 80 can sit within pocket 78. The user can pull up flap 72 via extended lip 76, add loose powder to tray 70, and then push flap 72 back down to cover loose powder tray 70. Loose powder tray 70 can also have raised ridges 76 formed at the bottom thereof to provide friction and remove excess powder from the powder puff as needed, as well as to allow air to circulate so moisture does not cake up the powder against the puff.

In certain illustrative embodiments, compact box 20 can fold into a compact and convenient configuration for transport and storage. In an illustrative embodiment, end flap 44 of cover panel 28 can be tucked into a receiving slot 56 formed in bottom panel 26, such that when cover panel 28 is folded over to close compact box 20, cosmetics tray 48 can be covered to prevent spillage.

Assembly 10 provides an innovative way of carrying multiple cosmetic products in an ultra-slim, customizable, portable and disposable case for makeup touch ups. With assembly 10, the user walks away with the same exact products that the professional used but now contained in a personal sleek, glamorous, disposable compact. The makeup artist keeps their makeup and the client keeps her look. Assembly 10 provides a chic, cheap, compact, convenient, touch up solution for every user in every social situation—especially celebrities and socialites. Assembly 10 is desirable for any occasion where a person uses a professional makeup artist and/or carry makeup for touch ups: weddings, parties, award ceremonies, red carpet, press events, proms, graduations, corporate events, formal dinners, fashion shows, airplanes—or even on the job. The makeup artist is able to provide a client with a sample size of the artist's products for the most vital aspects of face maintenance: fading lips and a shiny face. The artist can use a spatula, which can be provided together with assembly 10, to extract a small amount of the products that were used on the client's face: lip stick, lip gloss, lip balm and face powder. These items can be placed into their respective compartments in the cosmetics tray. In addition, consumers will be able to purchase separate and disposable replacement trays, with or without makeup samples, and discard them after each use. The tray can also be utilized as an alternative to pre-filled sample packets. Thus, compact box 10 allows retail owners to sell samples of makeup from tester units as a customized service. This option allows small independent boutiques to sell samples of cosmetics to consumers without investing in the expense of having thousands of sampling packets that are giveaways. In addition to cardstock, assembly 10 can be made of, or covered with, other durable, stylish designs or materials such as leather, suede, leopard-print, etc. . . . For example, in certain illustrative embodiments, assembly 10 can be made of a plastic resin structure and covered with textiles such as suede, leopard-print, etc. . . .

It is to be understood that the invention is not limited to the exact details of construction, operation, exact materials, or illustrative embodiments shown and described, as modifications and equivalents will be apparent to one skilled in the art. Accordingly, the invention is therefore to be limited only by the scope of the appended claims.

What is claimed is:

1. A cosmetic storage assembly comprising:

a compact box including a floor panel, a cover panel, and a base panel, wherein the floor panel includes a front panel, a rear panel and opposite lateral side flaps, one of the lateral side flaps is disposed between the floor panel and the base panel, and the base panel is foldable along a seam with respect to the floor panel such that when folded, the base panel sits atop the floor panel, wherein the floor panel, the cover panel, the front panel and the side flaps are configured to fold along seams formed between the panels to create a chamber, the cover panel is movable relative to the floor panel between an open position and a closed position, wherein the cover panel comprises a flap and lateral side flaps, wherein the flap and the side flaps are foldable with respect to the cover panel to form a pocket between the flap and the cover panel, a window is formed on a front face of the pocket through which a mirror is affixed thereto, and the pocket having a single opening on a side end thereof and a tissue packet that is slidingly removable from the single opening in the pocket, the tissue packet having a perforated opening with a flap on its side, wherein said opening allows tissues to be pulled out of the packet while the packet remains within the pocket; and a single cosmetic tray removably disposed in the chamber of the compact box, the cosmetic tray including a plurality of wells and a plurality of corresponding hinged cover flaps for sealing each of the individual wells, wherein wherein each flap having an extended tab with a gripping bump disposed thereon, at least one of the wells has a plurality of subwells formed therein and the corresponding cover flap has a plurality of sealing bumps that form a depressed closure within the corresponding subwells when the hinged cover flap is in the closed position, one of the plurality of wells being a powder well with a floor having a plurality of rows of raised parallel ridges formed thereon and a powder puff removably disposed in the powder well and capable of sitting on top of the raised parallel ridges, the powder puff having a handle disposed thereon, at least one of the wells being a cosmetic tool well which includes at least one separating barrier wall disposed therein and extending along a median portion of the length of the well to separate the cosmetic tools, and the tool well having a floor with a raised platform, the raised platform extending only along a median portion of the length of the well such that when the cosmetic tools are disposed in the tool well, the ends of the cosmetic tools overlap ends of the raised platform.

* * * * *